US007772175B2

(12) United States Patent
Panandiker et al.

(10) Patent No.: US 7,772,175 B2
(45) Date of Patent: Aug. 10, 2010

(54) DETERGENT COMPOSITIONS FOR CLEANING AND FABRIC CARE COMPRISING A BENEFIT AGENT, DEPOSITION POLYMER, SURFACTANT AND LAUNDRY ADJUNCTS

(75) Inventors: Rajan Keshav Panandiker, West Chester, OH (US); Mark Robert Sivik, Mason, OH (US); Robert Joe McChain, Cincinnati, OH (US); Susan Eileen Buescher, Cincinnati, OH (US); Timothy Michael Rothgeb, Cincinnati, OH (US); Connie Lynn Sheets, Cincinnati, OH (US); Paul Francis Kindel, Reading, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 109 days.

(21) Appl. No.: 11/818,473

(22) Filed: Jun. 14, 2007

(65) Prior Publication Data

US 2007/0293414 A1 Dec. 20, 2007

Related U.S. Application Data

(60) Provisional application No. 60/815,241, filed on Jun. 20, 2006.

(51) Int. Cl.

| | |
|---|---|
| ***C11D 3/18*** | (2006.01) |
| ***C11D 1/00*** | (2006.01) |
| ***C11D 3/37*** | (2006.01) |
| ***C11D 3/386*** | (2006.01) |

(52) U.S. Cl. ..... 510/329; 510/276; 510/327; 510/394; 510/466; 510/475; 510/499; 510/504; 8/137

(58) Field of Classification Search ..... 510/276, 510/327, 329, 394, 466, 475, 499, 504; 8/137
See application file for complete search history.

(56) References Cited

U.S. PATENT DOCUMENTS

| | | | | |
|---|---|---|---|---|
| 5,037,818 | A * | 8/1991 | Sime | 514/183 |
| 7,056,879 | B2 | 6/2006 | Wang et al. | |
| 7,056,880 | B2 | 6/2006 | Wang et al. | |
| 2002/0065208 | A1 * | 5/2002 | Aubay et al. | 510/475 |
| 2004/0092425 | A1 * | 5/2004 | Boutique et al. | 510/466 |
| 2006/0083761 | A1 * | 4/2006 | Yoshimi et al. | 424/401 |

FOREIGN PATENT DOCUMENTS

| | | | |
|---|---|---|---|
| WO | WO 03/039499 | A | 5/2003 |
| WO | WO 2004/014326 | A | 2/2004 |
| WO | WO 2004/041983 | A | 5/2004 |
| WO | WO 2005/087907 | | 9/2005 |

* cited by examiner

*Primary Examiner*—Brian P Mruk
(74) *Attorney, Agent, or Firm*—Stephen T. Murphy; Leonard W. Lewis

(57) ABSTRACT

Detergent compositions comprising selected deposition polymers for improved deposition of fabric care benefit agents, such as organosilicones, polyolefin dispersions, polymer latexes, microencapsulated fabric care actives, onto fabrics through the laundering operation.

7 Claims, No Drawings

DETERGENT COMPOSITIONS FOR CLEANING AND FABRIC CARE COMPRISING A BENEFIT AGENT, DEPOSITION POLYMER, SURFACTANT AND LAUNDRY ADJUNCTS

CROSS-REFERENCES TO RELATED APPLICATIONS

This application claims the benefit of U.S. Provisional Application Ser. No. 60/815,241 filed Jun. 20, 2006.

FIELD OF THE INVENTION

This invention relates to detergent compositions comprising selected deposition polymers for improved deposition of fabric care actives, such as organosilicones, polyolefin dispersions, polymer latexes, microencapsulated fabric care actives, onto fabrics through the laundering operation.

BACKGROUND OF THE INVENTION

In the modern world, with the increase of hustle and bustle and travel, there is a demand for reducing the time and labor involved in laundering and/or fabric care chores. That is, consumers desire a product that delivers not only excellence in cleaning, but also superior fabric care or garment care benefits, for example: superior garment appearance; excellent tactile characteristics, such as fabric feel and softness; fabric softness; reduction, removal or prevention of creases or wrinkles in garments; ease of ironing; garment shape retention and/or shape recovery; and fabric elasticity. Compositions that provide both cleaning and fabric care benefits are commonly known as "2-in-1 detergent compositions".

Fabric care benefit agents need to be deposited onto fabrics in order to provide the desired benefits. However, the deposition efficiency of the fabric care benefit agents under common laundering conditions is low. Most of the fabric care benefit agents remain in the wash liquor and are discarded with the wash liquor.

In order to increase the deposition of fabric care agents, deposition aids are often used. Deposition aids (for example, cationic deposition polymers) suitable for enhancing the deposition of fabric care benefit agents have been added to the laundry detergent compositions. Suitable deposition aids preferably do not interfere with the cleaning operation which removes substances from the fabrics, and at the same time, enhance the deposition of fabric care benefit agents onto the fabrics. In addition, suitable deposition aids preferably are compatible with the cleaning agents, detergent additives and/or fabric care agents in the composition and remain stable in the compositions.

The most commonly used deposition aids are cationic polysaccharides. U.S. Pat. Nos. 7,056,880 and 7,056,879 (both assigned to The Procter & Gamble Company, "P&G") disclose compositions employing cationic hydroxyethyl cellulose derivatives as deposition aids to increase the deposition of fabric care agents. Cationic guar gums and synthetic polymers for assisting and/or enhancing the deposition of silicones on fabrics are disclosed in WO 04/041983. However, the natural polysaccharide-based polymers are not compatible with detersive enzymes, particularly cellulases, amylases and mannanases. These enzymes are either purposefully incorporated in laundry detergents to increase cleaning and removal of pill and fuzz, or are present as impurities in other enzymes, for example, commercially available proteases and amylases contain a trace amount of cellulase. These enzymes break down polysaccharide-based polymers during the laundering operation in the washing machine, or during shipping and storage of the liquid detergents, thereby shortening the shelf life of the liquid detergents.

One way to circumvent this problem is to use a synthetic cationic polymer. A variety of synthetic cationic polymers are available. These polymers are listed in International Cosmetics Ingredient Dictionary and Handbook, $10^{th}$ Edition, published by The Cosmetics, Toiletry and Fragrance Association, Washington D.C. However, most of these commercially available cationic polymers are not compatible with laundry detergents containing anionic surfactants. It is believed that the cationic polymers interact strongly with anionic surfactants which lead to precipitation of the anion-cation complex. There are significant challenges to formulate liquid laundry products from these components.

Various combinations of cationic polymers, cross-linked silicones with free silanol groups and anionic surfactants are known. However, many of the cationic polymers do not formulate well to produce clear isotropic liquid detergent products. This is particularly observed when the cationic polymers are variations of polyquaternium-7. Polyquaternium 7 typically is produced by a monomer feed ratio of 70% acrylamide and 30% diallyldialkylammonium chloride (DADMAC). When the resulting copolymers are incorporated in liquid laundry detergent, they produce two-phased opaque products. Without being bound by theory, this is believed to be due to a large amount of unreacted DADMAC monomer and poly(DADMAC) oligomers that interact and precipitate with anionic surfactants, such as alkyl sulfates and alkyl ethoxysulfates, in the detergent composition. See, for example, WO 2005/097907.

Hence, there remains a need for improving fabric care benefits provided by laundry detergent compositions. In particular, there remains a need to select fabric care agent, deposition aid and cleaning agent that are compatible so that the resulting detergent composition is stable, deposits the fabric care agent efficiently, and provides superior cleaning and fabric care benefits.

SUMMARY OF THE INVENTION

The present invention provides laundry detergent compositions capable of enhanced deposition of fabric care benefit agents, the majority of which previously were lost in the wash liquor. The ingredients of the composition, such as cleaning agent, deposition polymers and fabric care benefit agents, are compatible and can be formulated into stable laundry detergent products.

Specifically, the composition comprises: a fabric care benefit agent; a non-polysaccaride based deposition polymer comprising one or more cationic monomeric units and one or more nonionic monomeric units, at least one surfactant, and at least one laundry adjunct.

The objects, features and advantages of the invention are further borne out in the following detailed description, examples and appended claims.

All percentages, ratios and proportions herein are on a weight basis based on an undiluted composition, unless otherwise indicated.

DETAILED DESCRIPTION OF THE INVENTION

Definitions

The term "substrate" or "treated substrate" as used herein means a piece of material, especially a fabric, a textile, a garment or a fabric article in general, having one or more of the fabric care benefits described herein as imparted thereto by a composition of the invention.

The term "fabric article" as used herein means articles of clothing, linen, drapery, and clothing accessories. The term also encompasses other items made in whole or in part of fabric, such as tote bags, furniture covers, tarpaulins and the like.

The term "detergent composition" or "laundry composition" as used herein, refers to a composition that provides cleaning as well as fabric care benefits. The term encompasses compositions for handwash, machine wash and other purposes such as soaking and/or pretreatment of stained fabrics.

As used herein, "effective amount" of a material or composition is the amount needed to accomplish an intended purpose, for example, to clean fabrics or to impart a desired level of fabric care benefit to a fabric article/substrate.

Detergent Compositions

The detergent compositions of the present invention are typically in the liquid form, preferably using water as an aqueous carrier. Encapsulated and/or unitized dose compositions are included, as are compositions which comprise two or more separate but combinedly dispensable portions. The detergent composition of the present invention comprises fabric care benefit agents, non-polysaccaride based deposition polymers and other laundry adjuncts, preferably in a carrier comprising water. The detergent composition of the present invention has a viscosity from about 1 to about 2000 centipoise (1-2000 mPa*s), or from about 200 to about 800 centipoises (200-800 mPa*s). The viscosity can be determined using a Brookfield viscometer, No. 2 spindle, at 60 RPM's, measured at 25° C.

The detergent compositions of the present invention typically comprise from about 0.01 to about 10% by weight of the composition of the fabric care benefit agents, preferably from about 0.5 to about 5%, and more preferably from about 1 to about 3%. The fabric care benefit agents are preferably water-insoluble or water dispersible.

The detergent compositions of the present invention also comprise from about 0.0001 to about 10% by weight of the composition of the non-polysaccharide based deposition polymers, preferably from about 0.001 to about 5%, and more preferably from about 0.01 to about 2%. In some embodiments, the weight ratio of deposition polymer to fabric care benefit agent ranges from about 1:50 to about 1:1, or from about 1:20 to about 1:5.

The detergent compositions of the present invention comprise effective amounts of laundry adjuncts, such as perfume, detersive surfactant, enzyme, bleach, bleach activator, enzyme stabilizing system, or combinations thereof. Unless specified hereinbelow, an "effective amount" of a particular laundry adjunct is preferably from about 0.0001%, more preferably from about 0.01%, even more preferably from about 1% to about 25%, more preferably to about 20%, even more preferably to about 15%, still even more preferably to about 10%, most preferably to about 5% by weight of the composition.

The balance of the detergent compositions of the present invention comprises a carrier, which typically comprises water, and optionally organic solvents. In some embodiments, water is from about 85 to about 100 wt % of the carrier.

A typical embodiment of the invention is a composition comprising at least about 0.01% preferably from about 0.01% to about 10% by weight of the composition of a fabric care benefit agent, at least about 0.0005% preferably from about 0.0025% to about 6% by weight of the composition of an emulsifier for suspending the benefit agent in an aqueous composition, at least about 0.01% preferably from about 0.01% to about 10% by weight of the composition of a deposition polymer, at least about 0.01%, preferably at least 0.1% by weight of the composition of a detersive surfactant; an effective amount of other laundry adjunct materials; and the balance of a carrier, preferably water.

Fabric Care Benefit Agents

As used herein, "Fabric care benefit agents" refers to detergent ingredients which are water dispersible or water insoluble and can provide fabric care benefits such as fabric softening, color protection, pill/fuzz reduction, anti-abrasion, anti-wrinkle, perfume longevity and the like, to garments and fabrics, particularly on cotton garments and fabrics.

These fabric care benefit agents typically have the solubility in distilled water of less than 100 g/L, preferably less than 10 g/L at 25° C. It is believed that if the solubility of the fabric care benefit agent is more than 10 g/L, it will remain soluble in the wash liquor and consequently will not deposit onto the fabrics.

Non-limiting examples of water insoluble fabric care benefit agents include dispersible polyolefins, polymer latexes, organosilicones, perfume or other active microcapsules, and mixtures thereof. The fabric care benefit agents can be in the form of emulsions, latexes, dispersions, suspensions, micelles and the like, and preferably in the form of microemulsions, swollen micelles or latexes. As such, they can have a wide range of particle sizes from about 1 nm to 100 um and preferably from about 5 nm to 10 um. The particle size of the microemulsions can be determined by conventional methods, such as using a Leeds & Northrup Microtrac UPA particle sizer.

Emulsifiers, dispersing agents and suspension agents may be used. The weight ratio of emulsifiers, dispersing agents or suspension agents to the fabric care benefit agents is about 1:100 to about 1:2. Preferably, the weight ratio ranges from about 1:50 to 1:5. Any surfactants suitable for making polymer emulsions or emulsion polymerizations of polymer latexes can be used to make the water insoluble fabric care benefit agents of the present invention. Suitable surfactants include anionic, cationic, and nonionic surfactants or mixtures thereof. Nonionic and anionic surfactants are preferred.

Typically, the emulsification of the care agent is achieved in situ in the liquid detergent. In such case, the benefit agent is slowly added to the liquid detergent with vigorous mixing. Suitable water insoluble fabric care benefit agents include but are not limited to the examples described below.

(A) Organosilicones

Suitable organosilicones, include, but are not limited to (a) non-functionalized silicones such as polydimethylsiloxane (PDMS); and (b) functionalized silicones such as silicones with one or more functional groups selected from the group consisting of amino, amido, alkoxy, alkyl, phenyl, polyether, acrylate, siliconehydride, mercaptoproyl, carboxylate, sulfate phosphate, quaternized nitrogen, and combinations thereof.

In typical embodiments, the organosilicones suitable for use herein have a viscosity ranging from about 10 to about 700,000 CSt (centistokes) at 20° C. In other embodiments, the suitable organosilicones have a viscosity from about 10 to about 100,000 CSt.

(a) Polydimethylsiloxanes (PDMS) have been described in the Cosmetics and Toiletries Dictionary, cited above. They can be linear, branched, cyclic, grafted or cross-linked or cyclic structures. In some embodiments, the detergent compositions comprise PDMS having a viscosity of from about 100 to about 700,000 CSt at 20° C.

(b) Exemplary functionalized silicones include but are not limited to aminosilicones, amidosilicones, silicone polyethers, alkylsilicones, phenyl silicones and quaternary silicones.

The functionalized silicones suitable for use in the present invention have the following general formula:

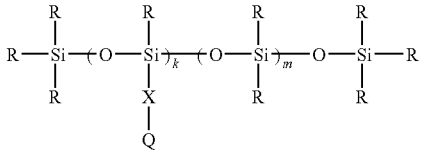

wherein m is from 4 to 50,000, preferably from 10 to 20,000;

k is from 1 to 25,000, preferably from 3 to 12,000;

each R is H or $C_1$-$C_8$ alkyl or aryl group, preferably $C_1$-$C_4$ alkyl, and more preferably a methyl group;

X is a linking group having the formula:

i) —$(CH_2)_p$— wherein p is from 2 to 6, preferably 2 to 3;

ii)

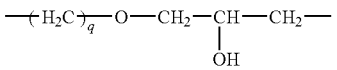

wherein q is from 0 to 4, preferably 1 to 2;

iii)

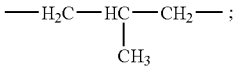

Q has the formula:

i) —$NH_2$, —NH—$(CH_2)_r$—$NH_2$, wherein r is from 1 to 4, preferably 2 to 3; or ii) —(O—$CHR_2$—$CH_2)_s$—Z, wherein s is from 1 to 100, preferably 3 to 30;

wherein $R_2$ is H or $C_1$-$C_3$ alkyl, preferably H or $CH_3$; and Z is selected from the group consisting of —$OR_3$, —OC(O)$R_3$, —CO—$R_4$—COOH, —$SO_3$, —$PO(OH)_2$, and mixtures thereof; further wherein $R_3$ is H, $C_1$-$C_{26}$ alkyl or substituted alkyl, $C_6$-$C_{26}$ aryl or substituted aryl, $C_7$-$C_{26}$ alkylaryl or substituted alkylaryl groups, preferably $R_3$ is H, methyl, ethyl propyl or benzyl groups; $R_4$ is —$CH_2$— or —$CH_2CH_2$— groups; and iii)

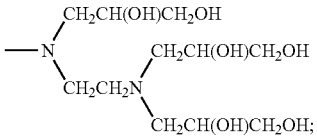

iv)

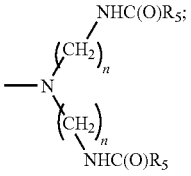

wherein each n is independently from 1 to 4, preferably 2 to 3;

and $R_5$ is C1-C4 alkyl, preferably methyl.

Another class of preferred organosilicone comprises modified polyalkylene oxide polysiloxanes of the general formula:

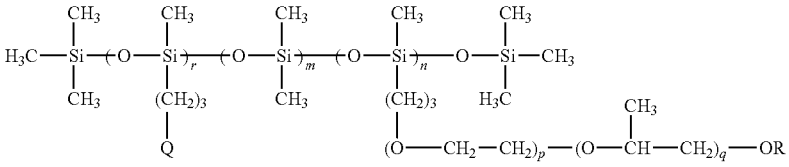

wherein Q is $NH_2$ or —$NHCH_2CH_2NH_2$; R is H or $C_1$-$C_6$ alkyl; r is from 0 to 1000; m is from 4 to 40,000; n is from 3 to 35,000; and p and q are integers independently selected from 2 to 30.

When r=0, nonlimiting examples of such polysiloxanes with polyalkylene oxide are Silwet® L-7622, Silwet® L-7602, Silwet® L-7604, Silwet® L-7500, Magnasoft® TLC, available from GE Silicones of Wilton, Conn.; Ultrasil® SW-12 and Ultrasil® DW-18 silicones, available from Noveon Inc., of Cleveland Ohio; and DC-5097, FF-400® available from Dow Corning® of Midland, Mich. Additional examples are KF-352®, KF-6015®, and KF-945®, all available from Shin Etsu Silicones of Tokyo, Japan.

When r=1 to 1000, nonlimiting examples of this class of organosilicones are Ultrasil® A21 and Ultrasil® A-23, both available from Noveon, Inc. of Cleveland, Ohio; BY16-876® from Dow Corning Toray Ltd., Japan; and X22-3939A® from Shin Etsu Corporation, Tokyo Japan.

A third class of preferred organosilicones comprises modified polyalkylene oxide polysiloxanes of the general formula:

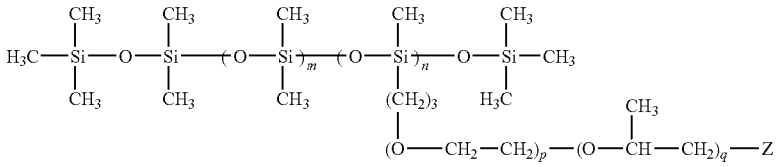

wherein m is from 4 to 40,000; n is from 3 to 35,000; and p and q are integers independently selected from 2 to 30; Z is selected from i.

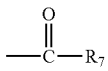

wherein $R_7$ is C1-C24 alkyl group;

ii.

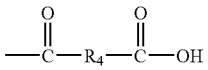

wherein $R_4$ is $CH_2$ or $CH_2CH_2$;

iii. —$SO_3$ iv.

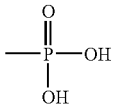

v.

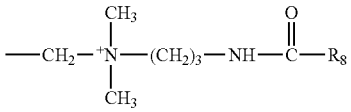

A— wherein $R_8$ is C1-C22 alkyl and A— is an appropriate anion, preferably $Cl^-$;

vi.

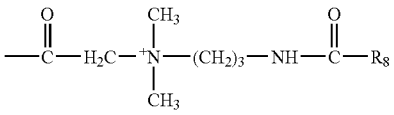

A— wherein $R_8$ is C1-C22 alkyl and A— is an appropriate anion, preferably $Cl^-$.

Another class of preferred silicones comprises cationic silicones. These are typically produced by reacting a diamine with an epoxide. They are described in WO 02/18528 and WO 04/041983 (both assigned to P&G), WO 04/056908 (assigned to Wacker Chemie) and U.S. Pat. No. 5,981,681 and U.S. Pat. No. 5,807,956 (assigned to OSi Specialties). These are commercially available under the trade names Magnasoft® Prime, Magnasoft® HSSD, Silsoft® A-858 (all from GE Silicones) and Wacker SLM21200®.

One embodiment of the composition of the present invention contains organosilicone emulsions, which comprise organosilicones dispersed in a suitable carrier (typically water) in the presence of an emulsifier (typically an anionic surfactant).

In another embodiment, the organosilicones are in the form of microemulsions. The organosilicone microemulsions may have an average particle size in the range from about 1 nm to about 150 nm, or from about 10 nm to about 100 nm, or from about 20 nm to about 50 nm. Microemulsions are more stable than conventional macroemulsions (average particle size about 1-20 microns) and when incorporated into a product, the resulting product has a preferred clear appearance. More importantly, when the composition is used in a typical aqueous wash environment, the emulsifiers in the composition become diluted such that the microemulsions can no longer be maintained and the organosilicones coalesce to form significantly larger droplets which have an average particle size of greater than about 1 micron. Since the selected organosilicones are water insoluble or have limited solubility in water, they will "crash" out of the wash liquor, resulting in more efficient deposition onto the fabrics and enhanced fabric care benefits. In a typical immersive wash environment, the composition is mixed with an excess of water to form a wash liquor, which typically has a weight ratio of water:composition ranging from 10:1 to 400:1.

A typical embodiment of the composition comprising from about 0.01% to about 10%, by weight of composition of the organosilicones and an effective amount of an emulsifier in a carrier. The "effective amount" of emulsifier is the amount sufficient to produce an organosilicone microemulsion in the carrier, preferably water. In some embodiments, the amount of emulsifiers ranges from about 5 to about 75 parts, or from about 25 to about 60 parts per 100 weight parts organosilicone.

The microemulsion typically comprises from about 10 to about 70%, or from about 25 to about 60%, by weight of the microemulsion of the dispersed organosilicones; from about 0.1 to about 30%, or from about 1 to about 20%, by weight of the microemulsion of anionic surfactant; optionally, from about 0 to about 3%, or from about 0.1 to about 20%, by weight of the microemulsion of nonionic surfactant; and the balance being water, and optionally other carriers. Selected organosilicone polymers (all those disclosed herinabove, excluding PDMS and cationic silicones) are suitable for forming microemulsions; these organosilicones are sometimes referred to as the "self emulsifying silicones". Emulsifiers, particularly anionic surfactants, may be added to aid the formation of organosilicone microemulsions in the composition. Optionally, nonionic surfactants useful as laundry adjuncts to provide detersive benefits can also aid the formation and stability of the microemulsions. In a typical embodiment, the amount of emulsifiers is from about 0.05% to about 15% by weight of the composition.

Nonlimiting examples of anionic surfactants include the following: alkyl sulfonates, such as $C_{11}$-$C_{18}$ alkyl benzene sulfonates (LAS) or $C_{10}$-$C_{20}$ branched-chain and random alkyl sulfates (AS); $C_{10}$-$C_{18}$ alkyl ethoxy sulfates ($AE_xS$) wherein x is from 1-30; mid-chain branched alkyl sulfates (U.S. Pat. No. 6,020,303 and U.S. Pat. No. 6,060,443) or mid-chain branched alkyl alkoxy sulfates (U.S. Pat. No. 6,008,181 and U.S. Pat. No. 6,020,303); $C_{10}$-$C_{18}$ alkyl alkoxy carboxylates comprising 1-5 ethoxy units; modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; $C_{12}$-$C_{20}$ methyl ester sulfonate (MES); $C_{10}$-$C_{18}$ alpha-olefin sulfonate (AOS); and $C_6$-$C_{20}$ sulfosuccinates.

(B) Dispersible Polyolefins

All dispersible polyolefins that provide fabric care benefits can be used as the fabric care benefit agents in the compositions of the present invention. The polyolefins can be in the form of waxes, emulsions, dispersions or suspensions. Nonlimiting examples are discussed below.

Preferably, the polyolefin is a polyethylene, polypropylene, or a mixture thereof. The polyolefin may be at least partially modified to contain various functional groups, such as carboxyl, alkylamide, sulfonic acid or amide groups. More preferably, the polyolefin is at least partially carboxyl modified or, in other words, oxidized.

For ease of formulation, the dispersible polyolefin is preferably introduced as a suspension or an emulsion of polyolefin dispersed in an aqueous medium by use of an emulsifying agent. When an emulsion is employed, the emulsifier may be any suitable emulsification agent including anionic, cationic, or nonionic surfactants, or mixtures thereof. Almost any suitable surfactant may be employed as the emulsifier of the present invention. The dispersible polyolefin is dispersed by use of an emulsifier or suspending agent in a ratio 1:100 to about 1:2. Preferably, the ratio ranges from about 1:50 to 1:5.

The polyolefin suspension or emulsion preferably comprises from about 1% to about 60%, more preferably from about 10% to about 55%, and most preferably from about 20 to about 50% by weight of polyolefin.

The polyolefin preferably has a wax dropping point (see ASTM D3954-94, volume 15.04 "Standard Test Method for Dropping Point of Waxes", the method incorporated herein by reference) from about 20 to 170° C. and more preferably from about 50 to 140° C. Suitable polyethylene waxes are available commercially from suppliers including but not limited to Honeywell (A-C polyethylene), Clariant (Velustrol emulsion), and BASF (LUWAX).

(C) Polymer Latexes

Polymer latex is typically made by an emulsion polymerization process which includes one or more monomers, one or more emulsifiers, an initiator, and other components familiar to those of ordinary skill in the art. All polymer latexes that provide fabric care benefits can be used as water insoluble fabric care benefit agents of the present invention. Non-limiting examples of suitable polymer latexes include those disclosed in WO 02/018451 published in the name of Rhodia Chimie.

Polymer latexes suitable for use herein as fabric care benefit agents include those having a glass transition temperature of from about −120° C. to about 120° C. and preferably from about −80° C. to about 60° C. Suitable emulsifiers include anionic, cationic, nonionic and amphoteric surfactants. Suitable initiators include all initiators that are suitable for emulsion polymerization of polymer latexes. The particle size of the polymer latexes can be from about 1 nm to about 10 μm and is preferably from about 10 nm to about 1 μm.

(D) Microencapsulated Actives

Fabric care benefit agents may be in the form of microcapsules or microencapsulates containing one or more fabric care active materials. The terms "microcapsules" and "microencapsulates" are used interchangeably herein. One type of microcapsule, referred to as a wall or shell capsule, comprises a generally spherical hollow shell of insoluble polymer material, within which the active material is contained.

Active materials which may be contained within the microcapsule include but are not limited to perfumes, flugicides, odor control agents, antistatic agents, fluorescent whitening agents, antimicrobial actives, UV protection agents, flame retardants, brighteners, and the like.

In one embodiment, the microcapsule is one that is friable in nature. "Friability" refers to the propensity of the microcapsules to rupture or break open when subjected to direct external pressures or shear forces. For purposes of the present invention, the microcapsules utilized are "friable" if, while attached to fabrics treated therewith, they can be ruptured by the forces encountered when the capsule-containing fabrics are manipulated by being worn or handled (thereby releasing the contents of the capsule).

In one embodiment, the microcapsules typically have a mean diameter in the range 1 micrometer to 100 micrometers, alternatively from 5 micrometers to 80 microns.

In another embodiment, microcapsules vary in size having a maximum diameter (longest dimension) between about 5 microns and about 300 microns, alternatively between about 10 microns and about 200 microns. As the capsule particle size approaches 300 microns, e.g. 250 microns), a reduction in the number of capsules entrained in the fabric may be observed.

In another embodiment, the capsules utilized in the present invention generally have an average shell thickness ranging from about 0.1 micron to 50 microns, alternatively from about 1 micron to about 10 microns.

Various microcapsules are known in the art, particularly perfume microcapsules such as those described in US 2005/0192204 A1, paragraphs 37-43; US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; US RE 32713; U.S. Pat. No. 4,234,627.

In one embodiment of the invention, the shell of the microcapsule comprises an aminoplast resin. A method for forming such shell capsules includes polycondensation. Aminoplast resins are the reaction products of one or more amines with one or more aldehydes, typically formaldehyde. Non-limiting examples of suitable amines include urea, thiourea, melamine and its derivates, benzoguanamine and acetoguanamine and combinations of amines. Suitable cross-linking agents (e.g., toluene diisocyanate, divinyl benzene, butane diol diacrylate etc.) may also be used and secondary wall polymers may also be used as appropriate, e.g. anhydrides and their derivatives, particularly polymers and co-polymers of maleic anhydride as disclosed in WO 02/074430. In another embodiment, the shell of the microcapsules comprises urea-formaldehyde; melamine-formaldehyde; or combinations thereof.

A perfume microcapsule contains an encapsulated perfume composition to provide a latent source of perfume. The perfume composition that is encapsulated may be comprised of 100% perfume, which encompasses individual perfume ingredients or perfume accords; optionally, the perfume composition may include non-volatile materials such as diluents. The diluent may be present from 0% to 50% of the perfume formulation. Exemplary diluents include isopropyl myristate, polyethylene glycol, propane diol.

Deposition Assisting Polymer or Deposition Polymer

The compositions of the present invention contain non-polysaccharide based cationic copolymers comprising the polymerized monomer unit residues of one or more ethylenically unsaturated cationic or amine monomers and one or more ethylenically unsaturated nonionic monomer and optionally one or more ethylenically unsaturated anionic monomers. When anionic monomeric units are present in the polymer, it is understood that the polymer is net cationic i.e., the number of cationic monomeric units are more than the number of anionic monomeric units in the polymer chain. Specifically, the cationic polymers are compatible with detersive enzymes in the detergent composition and are capable of assisting and/or enhancing the deposition of benefit agents onto fabrics during laundering.

Exemplary cationic or amine monomers useful in this invention are N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium chloride, acrylamidoalkylltrialkylamminium chloride, vinylamine, vinyl imidazole, quaternized vinyl imidazole and diallyl dialkyl ammonium chloride. Preferred cationic and amine monomers are N,N-dimethyl aminoethyl acrylate, N,N-dimethyl aminoethyl methacrylate (DMAM), [2-(methacryloylamino)ethyl]trimethylammonium chloride (QDMAM), N,N-dimethylaminopropyl acrylamide (DMAPA), N,N-dimethylaminopropyl methacrylamide (DMAPMA), acrylamidopropyl trimethyl ammonium chloride, methacrylamidopropyl trimethylammonium chloride (MAPTAC), quaternized vinyl imidazole and diallyldimethylammonium chloride.

Exemplary nonionic monomers suitable for use in this invention are acrylamide (AM), N,N-dialkyl acrylamide, methacrylamide, N,N-dialkylmethacrylamide, C1-C12 alkyl acrylate, C1-C12 hydroxyalkyl acrylate, C1-C12 hydroxyetheralkyl acrylate, C1-C12 alkyl methacrylate, C1-C12 hydroxyalkyl methacrylate, vinyl acetate, vinyl alcohol, vinyl formamide. Preferred nonionic monomers are acrylamide, N,N-dimethyl acrylamide, C1-C4 alkyl acrylate, C1-C4 hydroxyalkylacrylate, vinyl formamide, vinyl acetate, and vinyl alcohol. Most preferred nonionic monomers are acrylamide, hydroxyethyl acrylate (HEA), hydroxypropyl acrylate (HPA), vinyl formamide, vinyl acetate, and vinyl alcohol.

Cationic Monomers

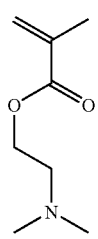

DMAM

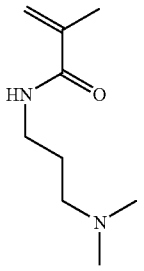

DMAPMA

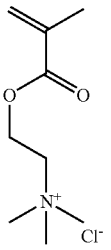

QDMAM

-continued

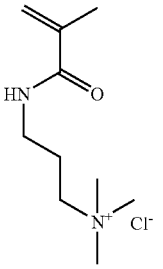

MAPTAC

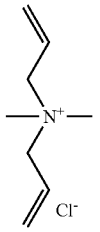

DADMAC

Neutral Monomers

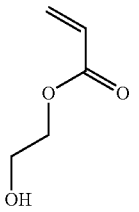

HEA

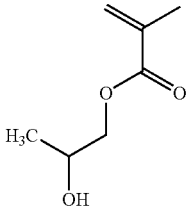

HPA

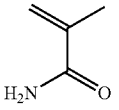

AM

The polymer may optionally comprises anionic monomers, such as acrylic acid, methacrylic acid, maleic acid, vinyl sulfonic acid, styrene sulfonic acid, acrylamidopropylmethane sulfonic acid (AMPS) and their salts.

The polymer may optionally be cross-linked. Crosslinking monomers include, but are not limited to, ethylene glycoldiacrylatate, divinylbenzene, butadiene.

The most preferred polymers are poly(acrylamide-co-diallyldimethylammonium chloride), poly(acrylamide-methacrylamidopropyltrimethyl ammonium chloride), poly(acrylamide-co-N,N-dimethyl aminoethyl methacrylate), poly (acrylamide-co-N,N-dimethyl aminoethyl methacrylate), poly(hydroxyethylacrylate-co-dimethyl aminoethyl methacrylate), poly(hydroxpropylacrylate-co-dimethyl aminoethyl methacrylate), poly(hydroxpropylacrylate-co-methacrylamidopropyltrimethylammonium chloride).

In order for the deposition polymers to be formulable and stable in the composition, it is important that the monomers are incorporated in the polymer to form a copolymer, especially true when monomers have widely different reactivity ratios are used. In contrast to the commercial copolymers, the deposition polymers herein have a free monomer content less than 10%, preferably less than 5%, by weight of the monomers. Preferred synthesis conditions to produce reaction products containing the deposition polymers and low free monomer content are described below.

The deposition assisting polymers can be random, block or grafted. They can be linear or branched. The deposition assisting polymers comprises from about 1 to about 60 mol percent, preferably from about 1 to about 40 mol percent, of the cationic monomer repeat units and from about 98 to about 40 mol percent, from about 60 to about 95 mol percent, of the nonionic (i.e., "neutral") monomer repeat units.

The deposition assisting polymer has a charge density of about 0.1 to about 5.0 milliequivalents/g (meq/g) of dry polymer, preferably about 0.2 to about 3 meq/g. This refers to the charge density of the polymer itself and is often different from the monomer feedstock. For example, for the copolymer of acrylamide and diallyldimethylammonium chloride with a monomer feed ratio of 70:30, the charge density of the feed monomers is about 3.05 meq/g. However, if only 50% of diallyldimethylammonium is polymerized, the polymer charge density is only about 1.6 meq/g. The polymer charge density is measured by dialyzing the polymer with a dialysis membrane or by NMR. For polymers with amine monomers, the charge density depends on the pH of the carrier. For these polymers, charge density is measured at a pH of 7.

The weight-average molecular weight of the polymer will generally be between 10,000 and 5,000,000, preferably from 100,000 to 2,00,000 and even more preferably from 200,000 and 1,500,000, as determined by size exclusion chromatography relative to polyethyleneoxide standards with RI detection. The mobile phase used is a solution of 20% methanol in 0.4M MEA, 0.1 M $NaNO_3$, 3% acetic acid on a Waters Linear Ultrahdyrogel column, 2 in series. Columns and detectors are kept at 40° C. Flow is set to 0.5 mL/min.

Carrier

The optional, but preferred, carrier in the present compositions can be water alone or mixtures of organic solvents with water. Suitable organic solvents are linear or branched lower (C1-C8) alcohols, diols glycerols or glycols; lower amine solvents such as $C_1$-$C_4$ alkanolamines, and mixtures thereof. Exemplary organic solvents include 1,2-propanediol, ethanol, glycerol, monoethanolamine and triethanolamine. Carriers can be absent, for example from anhydrous solid embodiments of the invention, but more typically are present at levels in the range of from about 0.1% to about 98%, preferably at least about 10% to about 95%, more usually from about 25% to about 75%. Highly preferred compositions afforded by the present invention are clear, isotropic liquids.

Laundry Adjuncts (a) Detersive Surfactants or Surfactants

The laundry products of the present invention may comprise from about 1% to 80% by weight of a surfactant. Preferably such compositions comprise from about 5% to 50% by weight of surfactant. Detersive surfactants utilized can be of the anionic, nonionic, zwitterionic, ampholytic or cationic type or can comprise compatible mixtures of these types. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

(b) Detersive Enzymes

Suitable detersive enzymes for use herein include protease, amylase, lipase, cellulase, carbohydrase, including mannanase and endoglucanase, and mixtures thereof. Enzymes are normally incorporated into detergent compositions at levels sufficient to provide a "cleaning-effective amount". (Cellulases are also typically employed in an amount sufficient to remove unwanted fibrils, which can contribute to unwanted "pill" and "fuzz" formation as well as dulling colors from cotton-based fabrics.) The term "cleaning-effective amount" refers to any amount capable of producing a cleaning, stain removal, soil removal, whitening, deodorizing, or freshness improving effect on substrates such as fabrics. Preferably, the laundry product compositions of the present invention may contain up to about 5 mg by weight, more typically from about 0.01 mg to about 3 mg, of active enzyme per gram of the detergent composition. Mixtures of protease (for cleaning) and cellulase (for fibril removal) are preferred. Stated otherwise, the compositions herein will typically comprise from about 0.001% to about 5%, preferably from about 0.01% to about 1% by weight of the composition, of a commercial enzyme preparation. Protease enzymes are preferably present in such commercial preparations at levels sufficient to provide from 0.005 to 0.1 Anson units (AU) of activity per gram of composition. Higher active levels may be desirable in highly concentrated detergent formulations.

(c) Perfume

In addition to the encapsulated perfume, perfume may also be incorporated into the detergent compositions of the present invention. The perfume ingredients may be premixed to form a perfume accord prior to adding to the detergent compositions of the present invention. As used herein, the term "perfume" encompasses individual perfume ingredients as well as perfume accords.

The level of perfume accord in the detergent composition is typically from about 0.0001% to about 2% or higher, e.g., to about 10%; preferably from about 0.0002% to about 0.8%, more preferably from about 0.003% to about 0.6%, most preferably from about 0.005% to about 0.5% by weight of the detergent composition.

The level of perfume ingredients in the perfume accord is typically from about 0.0001% (more preferably 0.01%) to about 99%, preferably from about 0.01% to about 50%, more preferably from about 0.2% to about 30%, even more preferably from about 1% to about 20%, most preferably from about 2% to about 10% by weight of the perfume accord. Exemplary perfume ingredients and perfume accords are disclosed in U.S. Pat. No. 5,445,747; U.S. Pat. No. 5,500,138; U.S. Pat. No. 5,531,910; U.S. Pat. No. 6,491,840; and U.S. Pat. No. 6,903,061.

(d) Other Adjuncts

Examples of other suitable laundry adjunct materials include, but are not limited to, alkoxylated benzoic acids or salts thereof such as trimethoxy benzoic acid or a salt thereof (TMBA); inorganic builders including inorganic builders such as zeolites and water-soluble organic builders such as polyacrylates, acrylate/maleate copolymers and the like; bleaches such as catalytic metal complexes, activated peroxygen sources, bleach activators, bleach boosters, photobleaches, bleaching enzymes, free radical initiators, and hypohalite bleaches; coatings or encapsulating agents including polyvinylalcohol film or other suitable variations, sugars, PEG, waxes, or combinations thereof; enzyme stabilizing systems; chelants including aminocarboxylates, aminophosphonates, nitrogen-free phosphonates, and phosphorous and carboxylate-free chelants; scavenging agents including fixing agents for anionic dyes, complexing agents for anionic surfactants, and mixtures thereof; effervescent systems comprising hydrogen peroxide and catalase; optical brighteners or fluorescers; soil release polymers; dispersants; suds suppressors; dyes; colorants; filler salts such as sodium sulfate; hydrotropes such as toluenesulfonates, cumenesulfonates and naphthalenesulfonates; photoactivators; hydrolysable surfactants; preservatives; anti-oxidants; fabric softeners; anti-shrinkage agents; anti-wrinkle agents; germicides; fungicides; color speckles; colored beads, spheres or extrudates; sunscreens; fluorinated compounds; clays; luminescent agents or chemiluminescent agents; anti-corrosion and/or appliance protectant agents; alkalinity sources or other pH adjusting agents; solubilizing agents; processing aids; pigments; free radical scavengers, and mixtures thereof. Polysaccharide-based adjuncts and ingredients are preferably avoided herein, especially when cellulase enzymes are present. Hence, the preferred compositions herein are substantially free (i.e., less than about 1% preferably less than about 0.2%, more preferably 0%) of polysaccharide-based ingredients. Suitable materials include those described in U.S. Pat. Nos. 5,705,464, 5,710,115, 5,698,504, 5,695,679, 5,686,014 and 5,646,101. Typical usage levels range from as low as 0.001% by weight of composition for adjuncts such as optical brighteners and sunscreens to 50% by weight of composition for builders.

Preparation of the Compositions of the Invention

Incorporation of benefit agents and deposition polymers into compositions of the invention can be done in any suitable manner and can, in general, involve any order of mixing or addition.

For Example, the benefit agents and/or deposition polymers as received from the manufacturer can be introduced directly into a preformed mixture of two or more of the other components of the final composition. This can be done at any point in the process of preparing the final composition, including at the very end of the formulating process. That is, the benefit agents and/or deposition polymers can be added to a pre-made liquid laundry detergent to form the final composition of the present invention.

In another example, the benefit agents can be premixed with an emulsifier, a dispersing agent or a suspension agent to form an emulsion, a latex, a dispersion, a suspension, and the like, which is then mixed with other components (such as deposition polymers, detersive surfactants, etc.) of the final composition. These components can be added in any order and at any point in the process of preparing the final composition.

A third example involves mixing the benefit agents or the deposition polymers with one or more adjuncts of the final composition and adding this premix to a mixture of the remaining adjuncts.

Use of Composition of the Invention and Method of Treating Substrates

A method of treating a substrate comprises the step of contacting the substrate with the laundry detergent composition of the present invention. The contacting step may include direct application of the composition to the fabrics, application of the composition to fabrics via aqueous wash process or application of a wash liquor formed from the composition to the fabrics.

EXAMPLES

The following nonlimiting examples are illustrative of the deposition polymers useful in the present invention. All components are expressed in mole percent of the composition.

TABLE 1

| | Examples | | | | | | | | |
|---|---|---|---|---|---|---|---|---|---|
| | 1 | 2 | 3 | 4 | 5 | 6 | 7 | 8 | 9 |
| Acrylamide | 95 | 95 | 92.5 | 92.5 | 92.1 | | | | |
| Hydroxyethyl acrylate | | | | | | | | 96.2 | 95.8 |
| Hydroxypropyl acrylate | | | | | | 82.9 | 73.7 | | |
| DADMAC | 5 | | | | | | | | |
| DMAM | | 5 | | | | | 26.3 | 3.8 | 3.8 |
| MAPTAC | | | 7.5 | 7.5 | | | | | |
| QDMAM | | | | | 7.9 | | | | |
| DMAPA | | | | | | 17.1 | | | |
| Ethylene glycol diacrylate | | | | | | | | | 0.4 |
| Avg. mol. wt. (daltons) | $396.9 \times 10^3$ | $324.6 \times 10^3$ | $936.8 \times 10^3$ | $699.3 \times 10^3$ | $653.6 \times 10^3$ | $524.7 \times 10^3$ | $434.5 \times 10^3$ | $385.9 \times 10^3$ | $597.8 \times 10^3$ |

The following nonlimiting examples are illustrative of the synthesis of exemplary deposition polymers useful in the present invention.

Synthesis of the Copolymer of Example 1

A three-necked round bottomed flask is charged with argon and equipped with an overhead stirrer, heating mantle, and thermometer. Potassium phthalate buffer (pH 4, 0.05 M, 70° C., 250 mL) is added to the flask followed by the addition of acrylamide (36.04 g, 0.51 mol), concentrated HCl (0.25 mL) and diallyldimethylammonium chloride (4.00 g, 0.02 mol). 2,2'-Azobis(2-methylpropionamidine) dihydrochloride (0.30 g, 0.001 mol) as a 10% wt/volume solution (10 mL) is added to the reaction mixture. The contents of the flask heat to approximately 80° C. This temperature is maintained and the contents of the flask are allowed to mix for 18 hours. The cooled reaction mixture yields a polymer solution as having a concentration mass/mass percent solids of 6.4%.

Synthesis of the Copolymer of Example 2

The polymer is synthesized as in Example 1 except for the ratio of acrylamide and DMAM is 95:5. The cooled reaction mixture yields a polymer solution as having a concentration mass/mass percent solids of 6.9%.

Synthesis of the Copolymer of Example 3

A three-necked round bottomed is charged with argon and equipped with an overhead stirrer, heating mantle, and thermometer. Water (50° C., 590 mL) is added to the flask followed by the addition of methacrylamidopropyl trimethylammonium chloride (8.01 g, 50%, 0.036 mol), 1 N HCl (0.20 mL) and acrylamide (32.01 g, 0.45 mol). Sodium persulfate (0.04 g, 0.0002 mol) as a 1% wt/volume solution (4 mL) is added to the reaction mixture. The contents of the flask heat to approximately 75° C. This temperature is maintained for 18 hours. The cooled reaction mixture yields a polymer solution as having a concentration mass/mass percent solids of 6.0%.

Synthesis of the Copolymer of Example 4

The polymer is synthesized as in Example 1 except for the ratio of acrylamide and MAPTAC is 92.5:7.5. The contents of the flask are stirred for 18 hours. The cooled reaction mixture yields a polymer solution as having a concentration mass/mass percent solids of 6.8%.

Synthesis of the Copolymer of Example 5

A three-necked round bottomed is charged with argon and equipped with an overhead stirrer, heating mantle, and thermometer. Warm water (600 mL) is added to the flask followed by the addition of [2-(methacryloylamino)ethyl]triethylammonium chloride (8.02 g, 0.037 mol, 75%), 1 N HCl (0.2 mL) and acrylamide (32.03 g, 0.45 mol). 2,2'-Azobis[2-(2-imidazolin-2-yl)propane]dihydrochloride (0.90 g, 0.003 mol) as a 10% wt/volume solution (9 mL) is added to the reaction mixture. The contents of the flask are kept warm and are allowed to mix for 18 hours. The cooled reaction mixture yields a polymer solution as having a concentration mass/mass percent solids of 6.7%.

Synthesis of the Copolymer of Example 6

A three-necked round bottomed is charged with argon and equipped with an overhead stirrer, heating mantle, and thermometer. Warm water (575 mL) is added to the flask followed by the addition of N,N-dimethylaminoethylmethacrylate (8.00 g, 0.051 mol), 2 N HCl (26 mL) and hydroxypropylacrylate (36.00 g, 0.246 mol). 2,2'-Azobis(2-methylpropionamidine)dihydrochloride (1.00 g, 0.004 mol) as a 10% wt/volume solution (10 mL) is added to the reaction mixture. The contents of the flask are kept warm and are allowed to mix for 18 hours. The cooled reaction mixture yields a polymer solution as having a concentration mass/mass percent solids of 6.5%.

Synthesis of the Copolymer of Example 7

The polymer is synthesized as in Example 6 except for the ratio of hydroxypropyl acrylate and DMAM is 73.7:26.3. The cooled reaction mixture yields a polymer solution as having a concentration mass/mass percent solids of 6.6%.

Synthesis of the Copolymer of Example 8

A three-necked round bottomed is charged with argon and equipped with an overhead stirrer, heating mantle, and thermometer. Water (60° C., 750 mL) is added to the flask followed by the addition of N,N-dimethylaminoethylmethacrylate (2.03 g, 0.013 mol), 1 N HCl (13 mL) and hydroxyethylacrylate (38.01 g, 0.33 mol). 2,2'-Azobis(2-methylpropionamidine)dihydrochloride (1.00 g, 0.004 mol) as a 10% wt/volume solution (10 mL) is added to the reaction mixture. The contents of the flask heat to approximately 70° C. The mixture cools to room temperature and the contents are allowed to stir for 18 hours. The reaction mixture yields a polymer solution as having a concentration mass/mass percent solids of 4.9%.

Synthesis of the Copolymer of Example 9

A three-necked round bottomed is charged with argon and equipped with an overhead stirrer, heating mantle, and thermometer. Water (60° C., 750 mL) is added to the flask followed by the addition of N,N-dimethylaminoethylmethacrylate (2.03 g, 0.013 mol), 1 N HCl (13 mL, 0.013 mol), hydroxyethylacrylate (38.01 g, 0.33 mol) and ethyleneglycol diacrylate (0.23 g, 0.001 mol). 2,2'-Azobis(2-methylpropionamidine) (1.00 g, 0.004 mol) as a 10% wt/volume solution (10 mL) is added to the reaction mixture. The contents of the flask heat to approximately 70° C. The mixture cools to room temperature and the contents are allowed to stir for 18 hours. The cooled reaction mixture yields a polymer solution as having a concentration mass/mass percent solids of 4.7%.

Example 10

Dialysis of Poly(diallyldimethyl ammonium chloride-co-acrylamide)

Poly(diallyldimethyl ammonium chloride-co-acrylamide) is available as Merquat® S, a 9% solution (10 g), which is diluted to 1000 mL and placed in Spectra Por Molecular-porous membrane tubing MWCO 12-14K (available from VWR Scientific). The sample is dialyzed against water for 52 h. The contents remaining in the tube are freeze dried to yield solid polymer.

Example 11

Dialysis of Poly(diallyldimethyl ammonium chloride-co-acrylamide)

The dialysis procedure of Example 10 is repeated Merquat® 2220, which comprises poly(diallyldimethyl ammonium chloride-co-acrylamide).

Example 12

The following nonlimiting examples are illustrative of the detergent compositions of the present invention. Percentages are by weight unless otherwise specified.

| Ingredient | Wt % |
|---|---|
| C12-15alkyl polyethoxylate (1.8) sulfate | 18.0 |
| Ethanol | 2.5 |
| Diethylene glycol | 1.3 |
| Propanediol | 3.5 |
| C12-13Alkyl polyethoxylate (9) | 0.4 |
| C12-14 fatty acid | 2.5 |
| Sodium cumene sulfonate | 3.0 |
| Citric acid | 2.0 |
| Sodium hydroxide (to pH 8.0) | 1.5 |
| Protease (32 g/L) | 0.3 |
| Organosilicone[1] | 2.0 |
| Deposition polymer[2] | 0.1-0.4 |
| Soil suspending polymers | 1.1 |

Water, perfume, enzymes, suds suppressor, to 100% brightener, enzyme stabilizers & other optional ingredients

1: Organosilicone is a blend of polydimethyl siloxane (Viscasil® 300M) and aminofunctional silicone (TP-3909) in a 3:1 weight ratio; both materials are supplied by GE Silicones, Wilton, Conn.

2: Deposition polymer can be one or more of the following: copolymers selected from Table 1, or commercially available copolymers selected from Table 2.

TABLE 2

| | Commercially Available deposition polymers | | |
|---|---|---|---|
| | 2A[i] | 2B[ii] | 2C[ii] |
| Acrylamide | 70 | 70 | 70 |
| DADMAC | 30 | 30 | 30 |
| DMAM | | | |
| Avg. mol. wt. (daltons) | $900 \times 10^3$ | $2600 \times 10^3$ | $1000 \times 10^3$ |
| Tradename | Merquat ® 2200 | Merquat ® S | Mirapol ® 550 |

[i]polymers available from Nalco Company, Naperville, IL;
[ii]polymers available from Rhodia Chemie, Aubervilles, France.

3. The organosilicones in the detergent composition can be selected from Table 3.

TABLE 3

| Example Number | Silicones | Supplied by |
|---|---|---|
| 3A | Dow Corning BY 16-878 ® | Dow Corning Corporation, Midland, MI |
| 3B | Ultrasil ® A-21 | Noveon Inc., Cleveland, OH |
| 3C | Ultasil ® A-23 | Noveon Inc., Cleveland, OH |
| 3D | Silsoft ® Tone | GE Silicones, Greenwich CT |
| 3E | Silwet ® L7622 | GE Silicones, Greenwich CT |
| 3F | DC FF-400 ® | Dow Corning Corporation |
| 3G | Magnasoft ® TLC | GE Silicones, Greenwich CT |
| 3H | DC SH-3775C ® | Dow Corning Corporation |
| 3I | Wacker SLM 21-200 ® | Wacker Silicones, Adrian MI |
| 3J | Silsoft ® A-858 | GE Silicones, Greenwich CT |

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

(a) from about 0.01 to about 10% by weight of the composition of a benefit agent selected from the group consisting of polyethylene, polypropylene, oxidized polyethylene, oxidized polypropylene and mixtures thereof;

(b) from about 0.1% to about 10% by weight of the composition of a non-polysaccharide based deposition polymer, the deposition polymer comprising one or more cationic monomeric units and one or more nonionic monomeric units;

(c) from about 1 to about 25% by weight of the composition of a detersive surfactant;

(d) from about 0.0001 to about 20% by weight of the composition of a laundry adjunct; and (e) a detersive enzyme;

(f) optionally, an organosilicone benefit agent and (g) the balance a carrier comprising water;

wherein weight ratio of the deposition polymer to benefit agent is from about 1:50 to about 1:1.

2. The composition according to claim 1 wherein the cationic monomeric unit is selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium chloride, acrylamidoalkylltrialkylamminium chloride, vinylamine, vinyl imidazole, quaternized vinyl imidazole, diallyl dialkyl ammonium chloride, and mixtures thereof; and the nonionic monomeric unit is selected from the group consisting of acrylamide, N,N-dialkyl acrylamide, methacrylamide, N,N-dialkylmethacrylamide, C1-C12 alkyl acrylate, C1-C12 hydroxyalkyl acrylate, C1-C12 hydroxyetheralkyl acrylate, C1-C12 alkyl methacrylate, C1-C12 hydroxyalkyl methacrylate, vinyl formamide, vinyl acetate, vinyl alcohol, and mixtures thereof.

3. The composition according to claim 1 wherein the deposition polymer comprises about 1 to about 60 mol percent of cationic monomeric units and about 40 to about 98 mol percent of nonionic monomeric units.

4. The composition according to claim 1 wherein the deposition polymer is selected from the group consisting of poly (acrylamide-co-diallyldimethylammonium chloride), poly (acrylamide-methacrylamidopropyltrimethyl ammonium chloride), polyacrylamide-co-N,N-dimethyl aminoethyl methacrylate), poly(acrylamide-co-N,N-dimethyl aminoethyl methacrylate), poly(hydroxyethylacrylate-co-dimethyl aminoethyl methacrylate), poly(hydroxpropylacrylate-co-dimethyl aminoethyl methacrylate), poly(hydroxpropylacrylate-co-methacrylamidopropyltrimethylammonium chloride), and mixtures thereof.

5. The composition according to claim 1 wherein the laundry adjunct is selected from the group consisting of a detersive surfactant, perfumes, bleach systems, and mixtures thereof.

6. The composition according to claim 1 which comprises a cellulase enzyme and is substantially free of polysaccharide-based ingredients.

7. A method for treating a substrate in need of treatment comprising contacting the substrate with a detergent composition according to claim 1 such that the substrate is treated.

* * * * *